US005222839A

United States Patent [19]

Ishida et al.

[11] Patent Number: 5,222,839

[45] Date of Patent: Jun. 29, 1993

[54] METHOD AND APPARATUS FOR UNDERWATER RECLAMATION

[75] Inventors: Kazunori Ishida; Yasutaka Nakai; Motoyoshi Ishii, all of Tokyo; Taisuke Kato, Wako; Kiyoyuki Abe, Sapporo, all of Japan

[73] Assignees: Fujita Corporation; Mitsui Engineering and Shipbuilding Co., Ltd.; Onoda Chemico Co. Ltd., all of Tokyo; Harada Co., Ltd., Oita, all of Japan

[21] Appl. No.: 715,309

[22] Filed: Jun. 10, 1991

Related U.S. Application Data

[63] Continuation-in-part of Ser. No. 608,522, Nov. 2, 1990, abandoned.

[30] Foreign Application Priority Data

Nov. 2, 1989 [JP] Japan ..... 1-285005

[51] Int. Cl.[5] ..... E02D 15/00

[52] U.S. Cl. ..... 405/303; 405/222; 405/223; 405/266; 405/269

[58] Field of Search ..... 405/222, 223, 269, 241, 405/263, 266, 15, 303

[56] References Cited

U.S. PATENT DOCUMENTS

| | | | |
|---|---|---|---|
| 3,499,293 | 3/1970 | Kato | 405/241 |
| 3,990,252 | 11/1976 | Louden | 405/222 |
| 4,084,383 | 4/1978 | Kukino et al. | 405/269 |
| 4,871,283 | 10/1989 | Wright | 405/269 X |

FOREIGN PATENT DOCUMENTS

| | | | |
|---|---|---|---|
| 174724 | 7/1989 | Japan | 405/223 |
| 190823 | 7/1989 | Japan | 405/223 |

*Primary Examiner*—David H. Corbin

*Attorney, Agent, or Firm*—Wenderoth, Lind & Ponack

[57] ABSTRACT

An improved method for underwater reclamation is disclosed. Dredged mud sent under pressure by an earth and sand conveying device is treated with solidifying material, and before it is solidified, it is directly fed to an underwater reclaiming apparatus. The treated mud is fed through a discharge port of the underwater reclaiming apparatus, while the discharge port is always maintained embedded at a constant depth in a previously deposited underwater reclamation mud layer at the bottom of the water. An apparatus for underwater reclamation that is suitable for practicing the improved method is also disclosed.

18 Claims, 4 Drawing Sheets

METHOD AND APPARATUS FOR UNDERWATER RECLAMATION

This application is a continuation-in-part of now abandoned application, Ser. No. 07/608,522 filed on Nov. 2, 1990, abandoned.

BACKGROUND OF THE INVENTION

1. Field of the Invention

The present invention relates to a method and an apparatus for underwater reclamation by making use of treated but not yet solidified mud.

2. Description of the Prior Art

Although the sludge forming a main constituent of dredged mud in itself cannot be used as a reclaimed foundation under its original condition, mud which is treated by subjecting it to improving treatment with, for instance, cement, lime or the like, but which is not yet solidified, is available for reclamation.

Heretofore, in order to construct large-diameter piles, underwater continuous walls or the like, a method of construction consisting of the steps of filling muddy water in an excavated hole for forming a pile or underwater continuous wall, and depositing concrete underwater via a tremie pipe to replace the above-mentioned muddy water, has been practiced.

However, a method of construction by underwater deposition of the above-described treated mud has been unprecedented.

In the event that the above-described treated mud which has a low slump and a small specific gravity should be placed in water by making use of a tremie pipe, there would arise problems such as the underwater feed pipe becoming blocked by the treated mud, the amount of deposition becoming irregular, and the discharge port of the above-mentioned feed pipe becoming exposed in the water, resulting in contamination of the water.

SUMMARY OF THE INVENTION

The present invention has been proposed in view of the above-mentioned problems of the prior art, and it is one object of the present invention to provide a method and an apparatus for underwater reclamation, which can deposit unsolidified treated mud in the water in a highly qualified and efficient manner without contaminating the water.

According to one feature of the present invention, there is provided a method for underwater reclamation consisting of the steps of treating dredged mud with solidifying material, feeding the treated but not yet solidified mud, which was conveyed under pressure by an earth and sand conveying device, directly to an underwater reclaiming apparatus, and discharging the treated mud through a discharge port of the reclaiming apparatus while the discharge port is always embedded at a constant depth in a previously deposited underwater reclamation mud layer.

According to another feature of the present invention, there is provided an apparatus for underwater reclamation comprising a high-pressure air-separator disposed above a chamber provided at the top of an underwater feed pipe and directly connected to a mud transport pipe, a stirring device which is installed within the chamber and serves to stir the treated mud which has high-pressure air removed by the air-separator, a screw type conveyor device for conveying the treated mud and a variable driving device for driving the conveyor device. Both the conveyor and the variable driving device are disposed within and longitudinally along the above-described underwater feed pipe. The above-mentioned treated mud discharge port at the tip end of the underwater feed pipe is provided with a device for opening and closing the underwater feed pipe, and a control means operable in such manner that the aforementioned treated mud may be discharged while the discharge port is always embedded at a constant depth in a previously deposited underwater reclamation mud layer at the bottom of the water.

Upon practicing the method for underwater reclamation according to the present invention, treated mud, which is prepared by treating dredged mud with solidifying material but which is not yet solidified, is fed directly to an underwater reclaiming apparatus. The treated mud is discharged through a discharge port of the reclaiming apparatus while the discharge port is embedded in a previously deposited underwater reclamation mud layer. Because of the fact that the discharge port is never exposed in the water, the treated mud can be reclaimed in the water without contaminating the water.

In operation of the apparatus for underwater reclamation according to the present invention, the above-described treated mud conveyed via an earth and sand conveyor device has high-pressure air contained therein, which may interfere in the underwater deposition thereof, removed by a high-pressure air-separator disposed above the chamber provided at the top of an underwater feed pipe. Thereafter, the treated mud is mixed and kneaded by the above-described stirring device for mixing and kneading the treated mud, and it is forcibly discharged in the water through a discharge port of the underwater feed pipe by means of a screw type conveyor device disposed within and longitudinally along the underwater feed pipe.

In this manner, since during discharge of the treated mud the discharge port is always kept embedded at a constant depth in a previously deposited reclamation mud layer at the bottom of the water due to control by the above-mentioned control means, a high-quality reclaimed foundation can be constructed without contaminating the water.

In addition, the speed of the screw type conveyor device for feeding the above-mentioned treated mud, which was conveyed to the underwater feed pipe via the aforementioned high-pressure air-separator and the aforementioned stirring device for mixing and kneading the aforementioned treated mud, to the discharge port, is controlled by the variable driving device according to the state of the treated mud and the deposition thereof. Thus, the working efficiency is improved, and the construction time can be shortened.

Furthermore, inverse flow from the discharge port into the underwater feed pipe at the beginning of the deposition process and upon movement of the underwater reclaiming apparatus, can be prevented by the opening/closing device provided at the discharge port.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

In the following, the present invention will be described in greater detail in connection with the illustrated embodiment of the invention.

Figure 1:
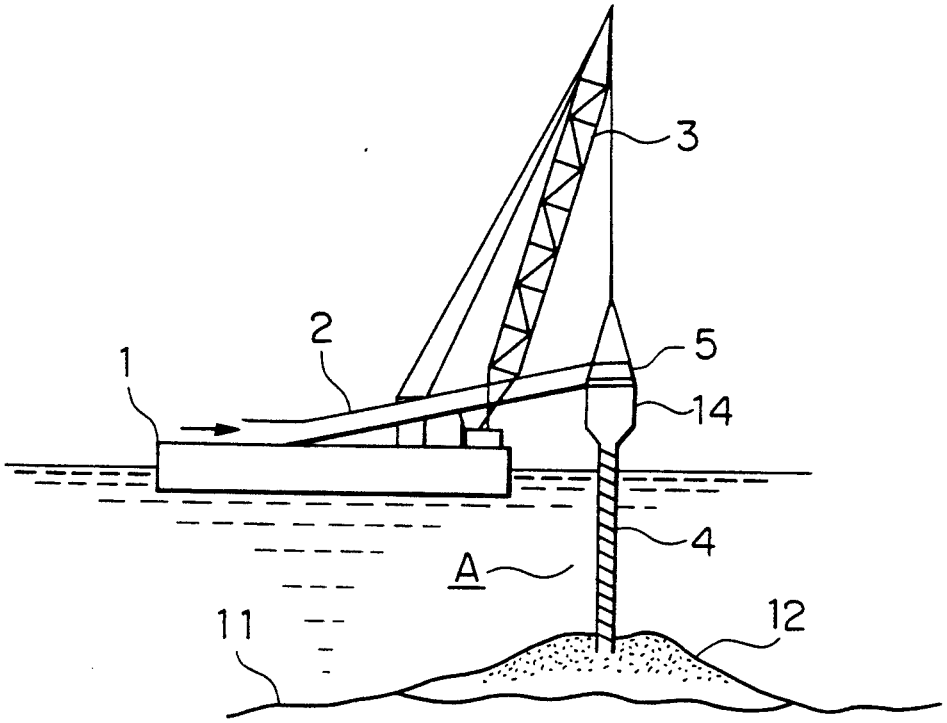
FIG. 1 is a side view showing a set up for practicing one preferred embodiment of the method for underwater reclamation according to the present invention.
Figure 2:
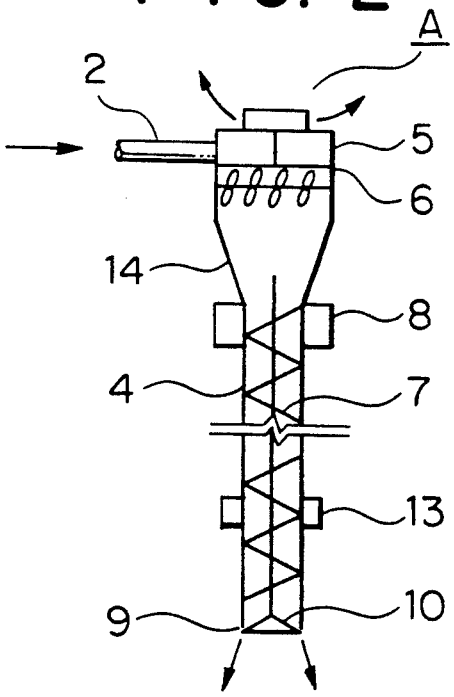
FIG. 2 is a longitudinal cross-section view showing one preferred embodiment of the apparatus for underwater reclamation according to the present invention.

In FIGS. 1 and 2, reference numeral 1 designates a work barge, on which a mud transport pipe 2 for conveying the above-described treated mud under pressure is mounted and also a crane 3 is loaded. An underwater reclaiming apparatus A for the above-mentioned treated mud is suspended from the crane 3 so as to be selectively raised and lowered, and the mud transport pipe 2 is directly connected to the underwater reclaiming apparatus A.

In the underwater reclaiming apparatus A, a high-pressure air-separator 5 is directly connected to the above-mentioned mud-transport pipe 2 and is disposed above a chamber 14 provided at the top of an underwater feed pipe 4. Within the chamber 14 is disposed a stirring device 6 for stirring the aforementioned treated mud which has high-pressure air removed by the above-described high-pressure air-separator 5. Under the stirring device 6 is disposed a screw type conveyor device 7 extending longitudinally within the underwater feed pipe 4, for conveying the treated mud. A variable speed driving device 8 for driving the conveyor device 7 is mounted to the underwater feed pipe 4.

A discharge port 9 at the tip end of the underwater feed pipe 4 is provided with a device 10 for opening and closing the discharge port 9. Furthermore, the underwater reclaiming apparatus A is provided with a control means 13 which is constructed in such manner that it can measure the reclaimed shape of an already reclaimed mud layer 12 on the foundation 11 at the sea bottom, on a real time basis, to send a control signal to the above-mentioned crane 3, such that the above-described treated mud can be deposited in the water while the discharge port 9 is always kept embedded at a constant depth in the already reclaimed mud layer 12.

Now, the above-mentioned treated mud prepared from dredged mud and conveyed to the underwater reclaiming apparatus A through the mud transport pipe 2 has high-pressure air contained therein removed by the high-pressure air-separator 5, directly connected to the mud transport pipe 2, in order to prevent air contained in the treated mud from interfering in the deposition of the mud. Thereafter, the treated mud is mixed and kneaded by the stirring device 6, is then forcibly conveyed to the discharge port 9 by means of the screw type conveyor device 7 that is driven by the above-mentioned variable driving device 7, and is deposited in the water through the discharge port 9.

At this time, the reclaimed shape of an already reclaimed mud layer 12 on the foundation 11 at the sea bottom is measured on a real time basis and a control signal is sent to a raising and lowering mechanism of the underwater reclaiming apparatus A making use of the crame 3 as controlled by the above-mentioned control means 13, in order to always maintain the discharge port 9 embedded at a constant depth in the already reclaimed mud layer 12. In this manner, the above-mentioned treated mud is reclaimed in the water, and hence reclamation can be achieved without causing contamination of the water.

In addition, a conveying speed of the screw type conveyor 7 is controlled by the above-mentioned variable driving device 8 on the basis of the state of the treated mud at the beginning or completion of the deposition process to change the deposition speed of the treated mud, and thereby improve the working efficiency.

Also, inverse flow from the discharge port 9 into the underwater feed pipe 5 in the beginning of deposition of the treated mud and upon movement of the underwater reclaiming apparatus A, can be prevented by means of the opening/closing device 10 provided at the discharge port 9.

Figure 3:
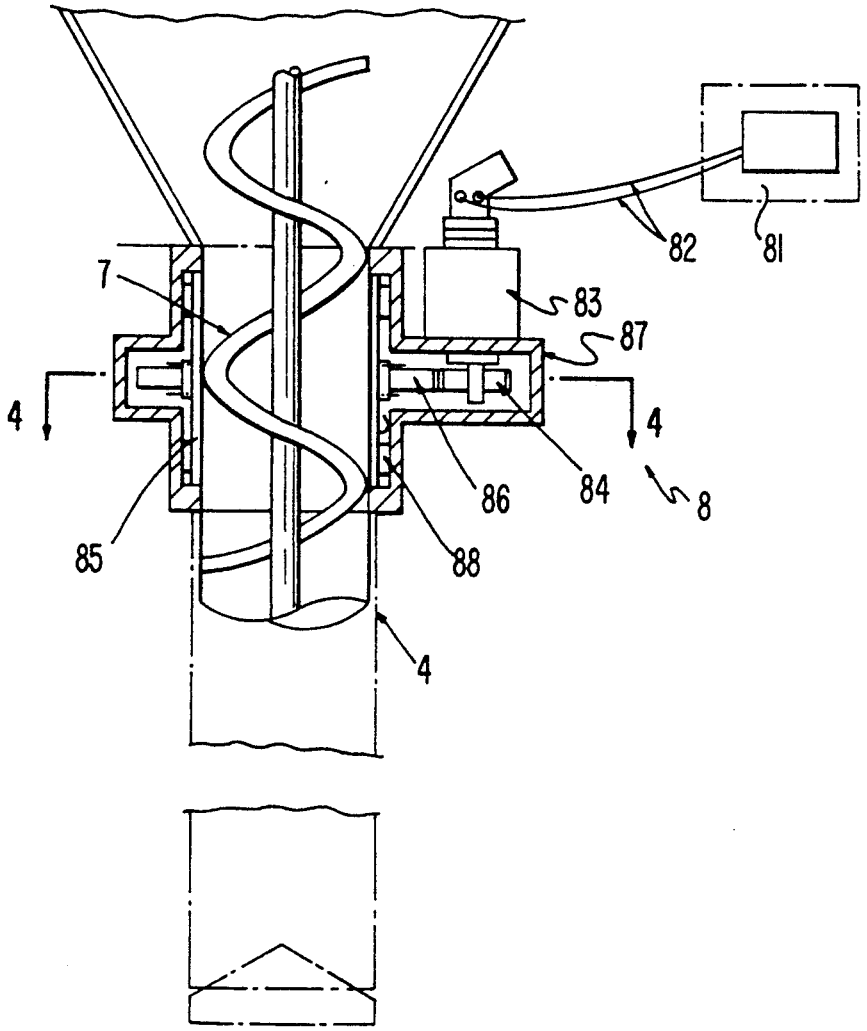
FIG. 3 is a partial longitudinal cross-sectional view illustrating a variable driving device for a screw type conveyor.
Figure 4:
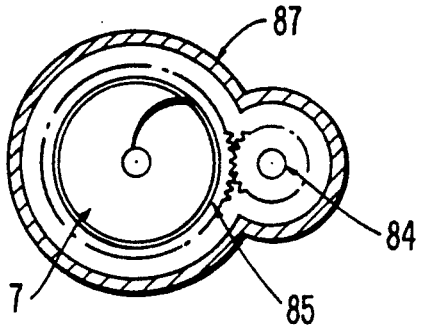
FIG. 4 is a cross-sectional view taken along line 4—4 of FIG. 3.

As shown in FIGS. 3 and 4, the variable driving device 8 for driving the screw type conveyor 7 includes a hydraulic unit 81 (composed of an electric motor and a hydraulic pump) mounted on the work barge and a hydraulic motor 82 connected to the hydraulic unit 81 by hydraulic hoses 83. High-pressure oil is supplied via the hydraulic hoses 2 to rotate the hydraulic motor 82 to drive the screw type conveyor 7. The hydraulic motor 82 is operably connected to a geared rotary drum 85, which is positioned above the underwater feed pipe 4, through a driving gear 84 and a driven gear 86 which is arranged on the output shaft of the motor 82. The hydraulic motor 82 is mounted to the feed pipe 4 by a transmission casing 87, and the rotary drum 85 is rotatably mounted in the casing 87 by way of metal bearings 88. Since conveyor 7 is operably connected to the inner wall of the geared rotary drum 85 along one spire of the screw, the screw type conveyor 7 is rotated by rotation of the hydraulic motor 82. As is well known, the rotational speed of the hydraulic motor 82 can be varied by varying the discharge of the hydraulic pump of the hydraulic unit 81, so as to thereby vary the rotational speed of the conveyor 7.

Figure 5:
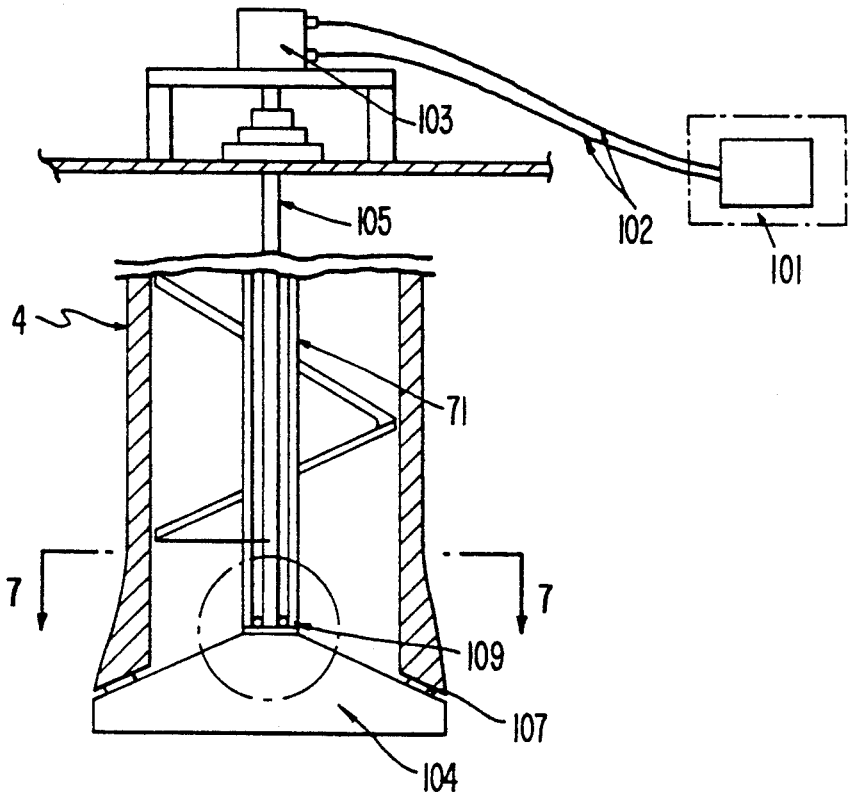
FIG. 5 is a partial longitudinal cross-sectional view illustrating an opening and closing device for a discharge port.
Figure 6:
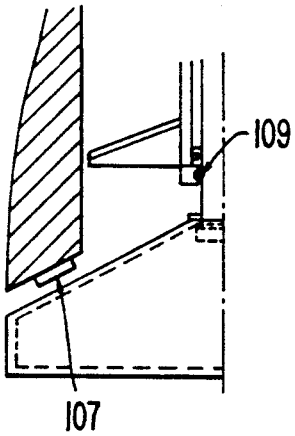
FIG. 6 is an enlarged view illustrating details of the opening and closing device of FIG. 5.
Figure 7:
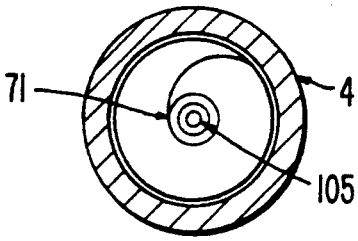
FIG. 7 is a cross-sectional view taken along line 7—7 of FIG. 5.

As shown in FIGS. 5-7, the opening/closing device 10 includes a hydraulic unit 101 (comprising a gate opening and closing electric motor and a hydraulic pump) installed on the work barge 1, a gate opening and closing hydraulic jack 103 (e.g. a piston/cylinder unit or the like) arranged over the upper chamber of the underwater reclaiming apparatus A and connected to the hydraulic unit 101 via hydraulic hoses 102, and an opening/closing gate 104 which is connected to the jack 103 via a connecting rod 105 (which is arranged in a hollow screw shaft 71). The underwater feed pipe 4 has a water seal 107 mounted on its lower end to prevent water from entering the feed pipe 4 when the gate 104 is fully closed. Also provided is a sealing device 109 for sealing the clearance between the screw shaft 71 and the connecting rod 105. It is noted that, although hydraulic unit 101 has been described as a separate unit from the hydraulic unit 81 of the variable driving device 8, the two hydraulic units can be one and the same.

Figure 8:
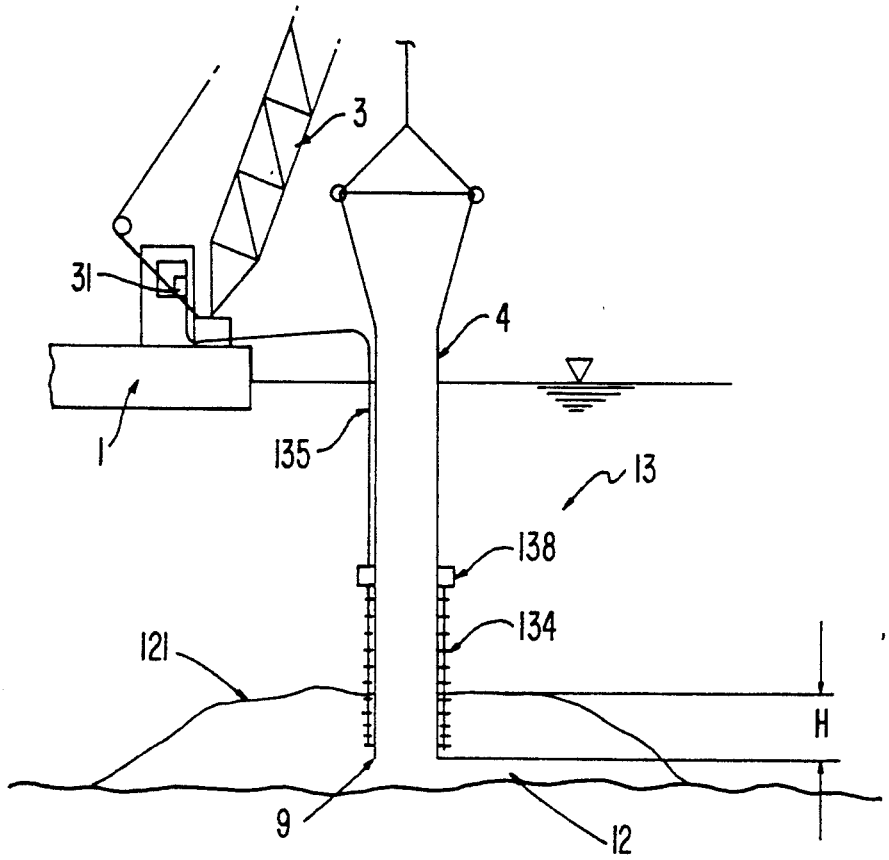
FIG. 8 is a side view illustrating a control means according to the invention.
Figure 9:
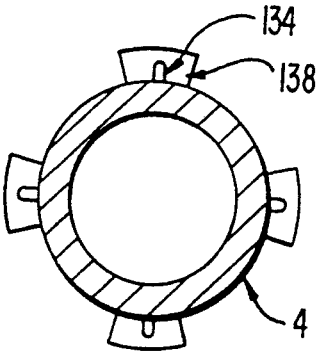
FIG. 9 is a cross-sectional view taken along line 9—9 of FIG. 10.
Figure 10:
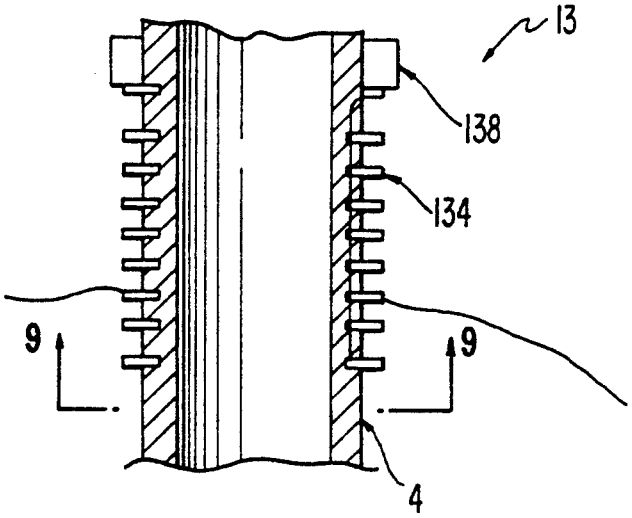
FIG. 10 is an enlarged view of a portion of the control means of FIG. 8.

As discussed above, in order to avoid contamination of the water during deposition of the treated but as yet unsolidified mud, (treated by adding a predetermined amount of cement solidifier to dredged soil, etc.), it is necessary that the discharge port 9 be maintained at a constant depth H in the previously reclaimed soil layer 12 (see FIG. 8). As shown in FIGS. 8–10, the control means 13 comprises a control section 138 and a plurality of temperature sensors 134 to monitor the distance from the discharge port 9 of the underwater feed pipe 4 to an upper surface 121 of the reclaimed mud layer 12.

The temperatures of the water and the treated soil, which has been placed in the water but not yet solidified, are detected by the temperature sensors 134, which are arranged at close intervals along the feed pipe 4 from the discharge port 9 to the control section 138. Temperature differences along the feed pipe 4, caused by temperature increases due to the exothermic reactions of the cement solidifier, are transduced into signals by the control section 138 and are sent via an electrical cable 135 to an operation control system 31 which is operable to automatically operate the crane 3 to vertically adjust the position of the underwater feed pipe 4. The correlation between the temperature gradients, detected by the temperature sensors 134 and control section 138, and the distance H to which the feed pipe 4 is buried can be readily determined by trial and error. With this arrangement, it is possible to maintain the discharge port 9 of the underwater feed pipe 4 at a constant depth H in the reclaimed mud layer 12. Note: In the present invention, the solidifier to be used is exemplified by a cement group (i.e., cement+fluidizer), lime ($CaCO_3$) group (i.e., lime+fluidizer), or their suitable mixture.

As will be obvious from the above detailed description of one preferred embodiment according to a first aspect of the present invention, a high-quality reclaimed foundation can be constructed without contaminating the water, due to the fact that the above-mentioned treated mud conveyed under pressure by an earth and sand conveyor device is fed directly to the underwater reclaiming apparatus, and because the treated mud is discharged through a discharge port of the reclaiming apparatus onto the bottom of the water while the discharge port is always embedded at a constant depth in a previously deposited underwater reclamation mud layer.

Also, according to a second aspect of the present invention, high-pressure air contained in the above-mentioned treated mud is removed by the high-pressure air-separator installed at the top of the underwater reclaiming apparatus. Thereafter, the treated mud is mixed and kneaded by the stirring device, and it is forced through the discharge port into the water by the screw type conveyor device disposed longitudinally within the underwater feed pipe. At this time, the treated mud can be deposited in the water without contaminating the water, due to the fact that the arrangement is such that the treated mud can be discharged while the discharge port is always embedded at a constant depth in an already reclaimed mud layer at the bottom of the water as controlled by the control section mounted to the underwater feed pipe.

Moreover, due to the fact that the speed of the screw type conveyor device can be varied by the variable driving device, the speed of deposition of the treated mud can be changed to improve the working efficiency. Thus, in response to changes in the state of the treated mud and the deposition thereof, construction time can be shortened. Further, the underwater reclamation method and apparatus are applicable to muds and soils having a wide variety of properties, from those having a low slump to those having a high slump and from those having a small specific gravity to those having a large specific gravity.

Furthermore, due to the provision of an opening/-closing device at the discharge port of the underwater feed pipe, inverse flow of the treated mud into the underwater feed pipe can be prevented at the beginning of the deposition process or upon movement of the underwater reclaiming apparatus.

While a principle of the present invention has been described above in connection with one preferred embodiment of the invention, it is intended that all matter contained in the description and illustrated in the accompanying drawings shall be interpreted to be illustrative and not as a limitation to the scope of the invention.

What is claimed is:

1. A method of underwater reclamation, comprising the steps of:

treating dredged mud with a solidifying material;

feeding the treated mud to an underwater reclaiming apparatus prior to solidification of the treated mud;

discharging the treated mud through a discharge port of said reclaiming apparatus;

providing a sensor for sensing the depth at which the discharge port is embedded in a previously deposited underwater reclamation mud layer; and while discharging the treated mud, maintaining said discharge port embedded at a substantially constant depth in the previously deposited underwater reclamation mud layer by automatically raising the discharge port when the sensor senses that the depth at which the discharge port is embedded in the mud layer has increased.

2. A method of underwater reclamation as recited in claim 1, further comprising the step of:

removing air from the treated mud after the treated mud has been fed to the underwater reclaiming apparatus.

3. A method of underwater reclamation as recited in claim 1, wherein said step of providing a sensor comprises mounting a plurality of sensors longitudinally along a portion of said reclaiming apparatus.

4. A method of underwater reclamation as recited in claim 1, wherein said step of providing a sensor comprises mounting a plurality of sensor about a portion of said reclaiming apparatus.

5. A method of underwater reclamation as recited in claim 1, wherein said step of providing a sensor comprises mounting a plurality of sensors about and longitudinally along a portion of said reclaiming apparatus.

6. A method of underwater reclamation as recited in claim 1, wherein said reclaiming apparatus comprises an underwater feed pipe with said discharge port at a bottom end thereof; and said step of providing a sensor comprises mounting a plurality of sensor longitudinally along a portion of said underwater feed pipe.

7. A method of underwater reclamation as recited in claim 1, wherein said reclaiming apparatus comprises an underwater feed pipe with said discharge port at a bottom end thereof; and said step of providing a sensor comprises mounting a plurality of sensors about a portion of said underwater feed pipe.

8. A method of underwater reclamation as recited in claim 1, wherein said reclaiming apparatus comprises an underwater feed pipe with said discharge port at a bottom end thereof; and said step of providing a sensor comprises mounting a plurality of sensors about and longitudinally along a portion of said underwater feed pipe.

9. A method of underwater reclamation as recited in claim 1, further comprising the steps of:

removing high pressure air from the treated mud; and mixing and kneading the treated mud.

10. An apparatus for underwater reclamation comprising:

an underwater feed pipe having a chamber at a top end thereof and a discharge port at a bottom end thereof;

a mud transport pipe connected to said chamber for transporting treated mud to said underwater feed pipe via said chamber; and control means for maintaining said discharge port of said underwater feed pipe embedded at a substantially constant depth in a previously deposited underwater reclamation mud layer, said maintaining means comprising a depth sensor for sensing the depth at which said discharge port is embedded in the previously deposited mud layer, and a means for automatically raising said discharge port when said depth sensor senses that the depth at which the discharge port is embedded has increased.

11. An apparatus as recited in claim 10, wherein said depth sensor comprises a plurality of sensors mounted longitudinally along a portion of said underwater feed pipe.

12. An apparatus as recited in claim 10, wherein said depth sensor comprises a plurality of sensors mounted about a portion of said underwater feed pipe.

13. An apparatus as recited in claim 10, wherein said depth sensor comprises a plurality of sensors mounted about and longitudinally along a portion of said underwater feed pipe.

14. An apparatus as recited in claim 10, further comprising a high-pressure air separator means for removing high-pressure air from the treated mud;

stirring means, mounted in said chamber, for mixing and kneading the treated mud;

a screw type conveyor means, mounted longitudinally within said underwater feed pipe, for conveying the treated mud from said top end thereof to said discharge port;

a variable speed drive means, mounted to said underwater feed pipe, for driving said screw type conveyor means at variable speeds; and an opening/closing means for opening and closing said discharge port of said underwater feed pipe.

15. An apparatus as recited in claim 14, wherein said depth sensor comprises a plurality of sensors mounted longitudinally along a portion of said underwater feed pipe.

16. An apparatus as recited in claim 14, wherein said depth sensor comprises a plurality of sensors mounted about a portion of said underwater feed pipe.

17. An apparatus as recited in claim 14, wherein said depth sensor comprises a plurality of sensors mounted about and longitudinally along a portion of said underwater feed pipe.

18. An apparatus as recited in claim 14, wherein said high-pressure air separator means is mounted above said chamber.

* * * * *